United States Patent [19]

Clowe

[11] 4,368,097

[45] Jan. 11, 1983

[54] ADJUSTABLE GLUE APPLICATOR ROLLS FOR CONTAINER LABELING MACHINE

[76] Inventor: Henry W. Clowe, 3600 Old Canton Rd., Jackson, Miss. 39216

[21] Appl. No.: 299,077

[22] Filed: Sep. 3, 1981

[51] Int. Cl.[3] ..... B05C 1/06

[52] U.S. Cl. ..... 156/578; 118/221; 118/258; 118/262

[58] Field of Search ..... 118/262, 258, 221, 259; 156/578

[56] References Cited

U.S. PATENT DOCUMENTS 2,495,174 1/1950 McClatchie ..... 118/262 X 2,520,768 8/1950 Kunicki ..... 118/262

3,616,778 11/1971 Sirvet et al. ..... 118/262

*Primary Examiner*—David A. Simmons

*Attorney, Agent, or Firm*—B. P. Fishburne, Jr.

[57] ABSTRACT

Peripherally contacting applicator and fountain rolls of a glue pot are mounted on individual pivots and are journaled on support yokes which are swingable toward and away from conveyed containers on a linear path adjacent to one side of the glue pot. The swinging of the two yokes and their supported applicator and fountain rolls is under control of two independent screw adjustment shafts having swiveled connections with the glue pot and yokes. The arrangement enables the application of glue to containers with and without recessed label receiving surfaces.

7 Claims, 4 Drawing Figures

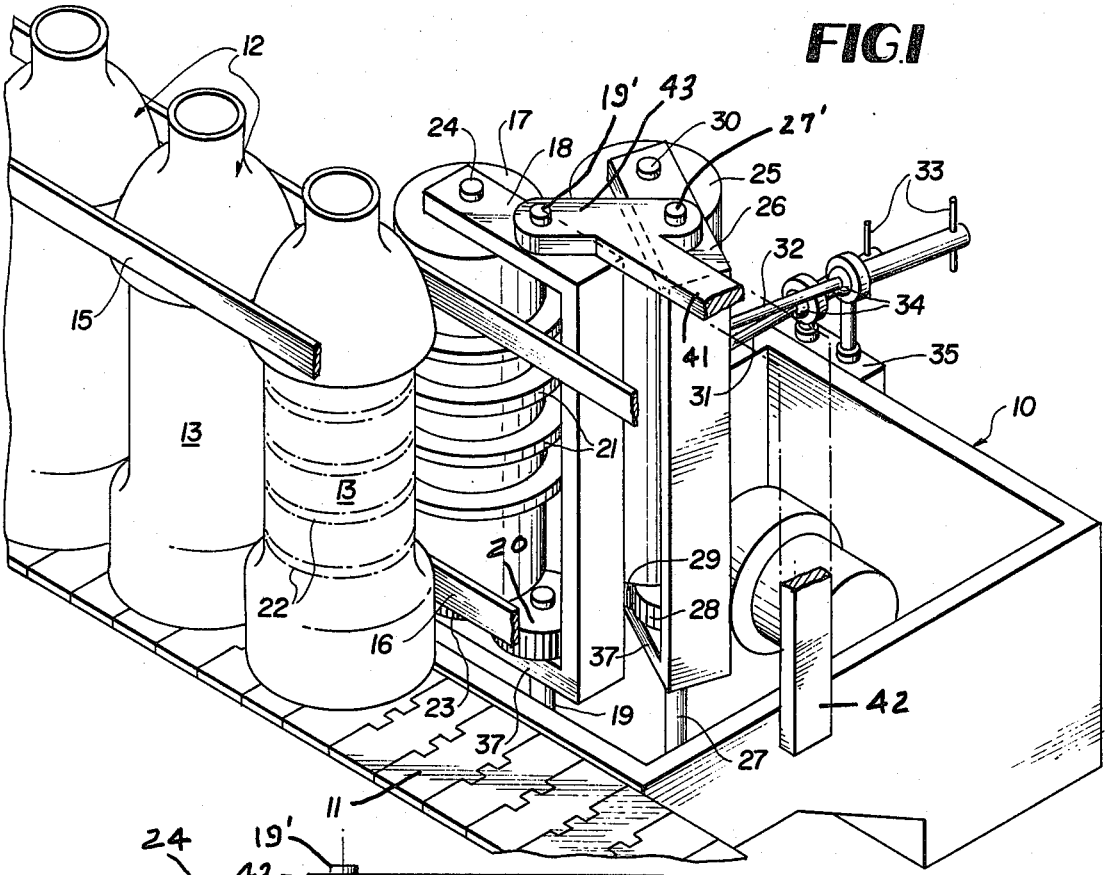
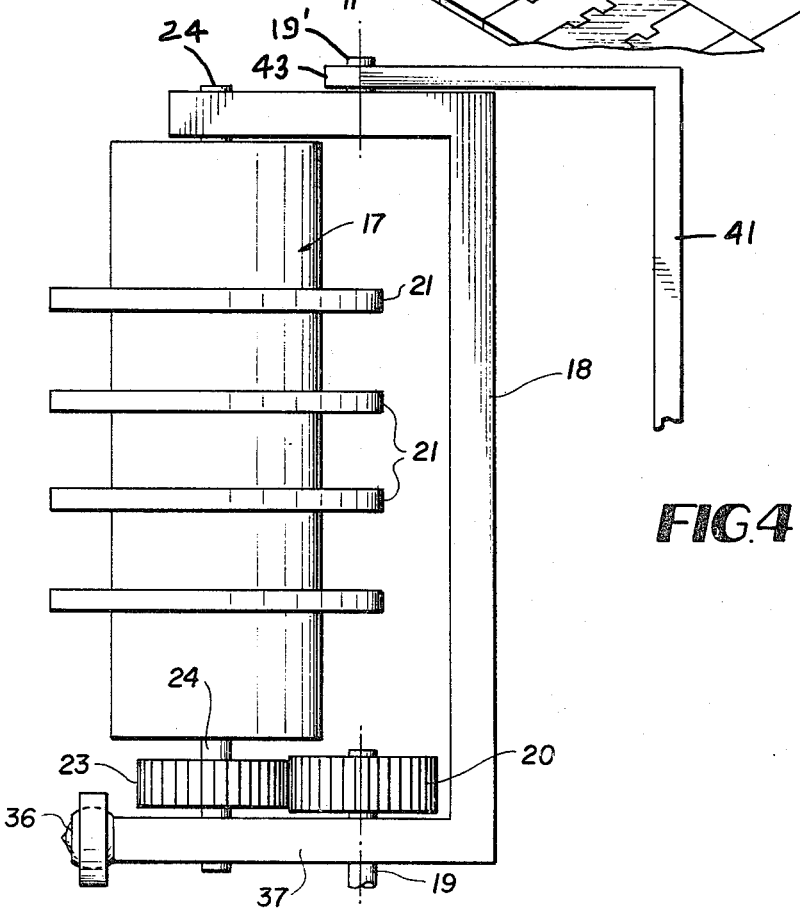
FIG.4

ADJUSTABLE GLUE APPLICATOR ROLLS FOR CONTAINER LABELING MACHINE

BACKGROUND OF THE INVENTION

Prior art container labeling machines are known in which conveyed rolling containers, such as bottles pass through the labeling machine on a linear path adjacent to glue applicator means in a horizontal mode and an upright mode. The present invention relates to improvements in the latter type of machine where the containers move past the glue applicator roller in an upright guided rolling mode.

In the prior art, when labels must be applied to containers having recessed and non-recessed labeling surfaces, difficult and time-consuming adjustments of the glue pot structure across the path of movement of the containers and along such path generally must be made.

The main objective of the present invention is to provide a simpler and more economical and convenient arrangement for adjusting the glue applicator and fountain rolls of a glue pot in relation to passing upright containers of either mentioned type without the necessity for adjusting the entire glue pot structure at least across the path of movement of the guided containers. The necessary adjustment of the two rolls can be made much more conveniently and quickly without requiring great skill. The adjusting means is self-locking in any selected adjusted position so that the rolls will not wander during operation of the machine. The two rolls of the glue pot are independently adjustable and independently driven through gears which are coaxial with the pivot axes of the support yokes for the two rolls. This particular geometry contributes to the precision action of the mechanism.

Other features and advantages of the invention will become apparent to those skilled in the art during the following description.

BRIEF DESCRIPTION OF THE DRAWINGS

FIG. 1 is a perspective view of the invention.

FIG. 4 is a fragmentary vertical section taken on line 4—4 of FIG. 2.

DETAILED DESCRIPTION

Figure 2:
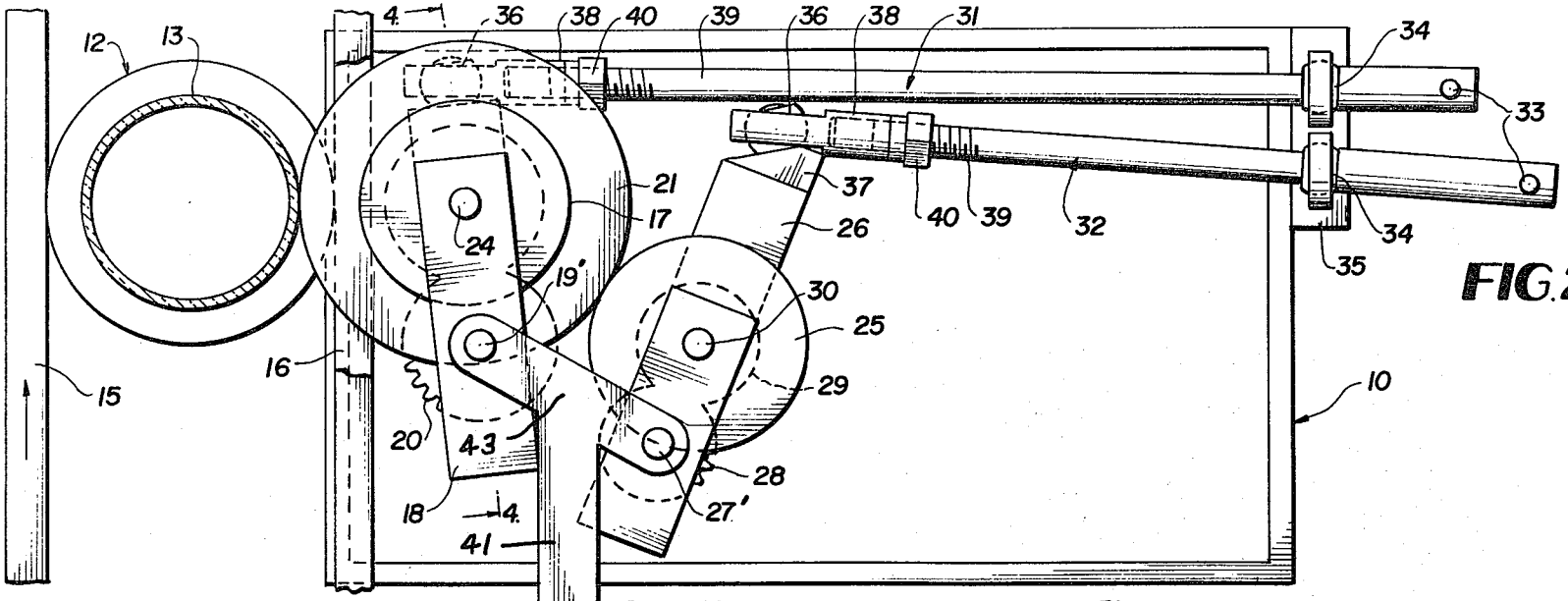
FIG. 2 is a plan view of the invention with the applicator and fountain rolls adjusted to apply glue to a container having a recessed labeling surface.

Referring to the drawings in detail wherein like numerals designate like parts, the numeral 10 designates a glue pot adjustably mounted adjacent to one side of a horizontal conveyor 11 for upright axis containers 12. These containers may have recessed label-receiving surfaces 13, FIGS. 1 and 2, or non-recessed label-receiving surfaces 14, FIG. 3. The adjustable glue applicator roller means according to the invention has the capability of applying glue with precision to either type of container.

As the containers move through the gluing station, they are caused to roll continuously on their upright axes through contact with a moving belt 15 on their outer sides and engagement with a guide rail 16 on their inner sides relative to the glue pot 10, and parallel to the belt 15. This mode of conveyance of the containers is conventional.

A glue applicator roll 17 having an upright axis parallel to the axes of the containers is journaled on a rigid yoke 18 which in turn is pivotally connected with an upright axis drive shaft 19 carrying a drive gear 20. The applicator roll 17 carries a series of spaced parallel glue applicator rings 21, whose peripheries contact the container areas 13 to apply axially spaced annular stripes 22 of glue thereto as the containers rollingly engage the properly adjusted applicator roll at the gluing station.

The drive shaft 19 is suitably driven by a means, not shown, underneath the glue pot 10. The drive gear 20 is in mesh with a driven gear 23 for the applicator roll 17 attached to the upright axis shaft 24 of the applicator roll.

A parallel axis fountain or supply roll 25 for glue is journaled on a swingable yoke 26 similar to the yoke 18 which is pivotally held on another upright axis drive shaft 27 carrying a gear 28 meshing with a companion gear 29 attached to the shaft 30 of fountain roll 25. The two rolls 17 and 25 are thus independently gear driven and are continuously driven throughout the full ranges of pivotal adjustment of the yokes 18 and 26 due to the coaxial relationship of the yoke pivots to the drive gears 20 and 28.

The yokes 18 and 26 and their rolls 17 and 25 are independently precision adjustable around the axes of shafts 19 and 27 by the operation of screw-adjusting shafts 31 and 32 each having a turning handle 33. Each adjusting screw shaft has a swiveled support at 34 on a ledge 35 of the glue pot 10. Each shaft 31 and 32 has a similar swiveled connection at 36 with the lower arm 37 of each yoke 18 and 26. Each screw adjusting shaft includes a female element 38 and a male element 39, as shown. A lock nut 40 is provided on each adjusting shaft to secure the elements 38 and 39 and the respective rolls 17 and 25 in their selected adjusted positions with precision.

It can be seen in FIG. 2 that the rings 21 of applicator roll 17 can be finely adjusted to rollingly engage the recessed surface 13 of each passing container 12 while the fountain roll 25 is independently adjusted into contact with the peripheries of the rings 21 to transfer glue thereto from the glue pot. No adjustment of the glue pot assembly 10 across the path of travel of the containers 12 is required, as necessitated by the prior art.

Figure 3:
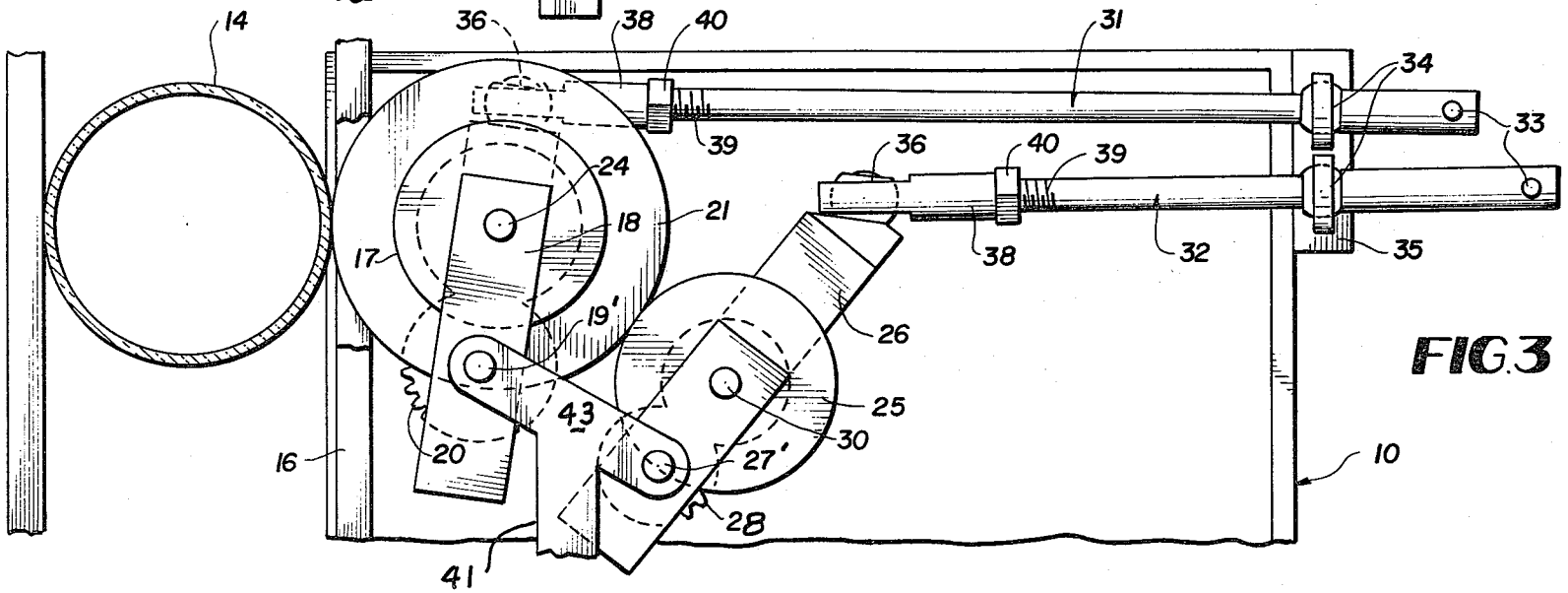
FIG. 3 is a similar view with the two rolls adjusted to apply glue to a non-recessed container.

When containers without recessed labeling areas are being processed as shown in FIG. 3, the two rolls 17 and 25 with their yokes 18 and 26 are appropriately adjusted by using the screw adjusting shafts 31 and 32 to back off the two rolls until they properly engage the label receiving surface 14 while maintaining contact with each other, again without necessitating movement of the glue pot assembly 10 relative to the containers.

It should also be explained that each yoke 18 and 26 at its top has a pivot extension 19' and 27' coaxial with shafts 19 and 27. A yoke stabilizer 41 is provided and has its vertical portion 42, FIG. 1, attached to one side wall of the glue pot 10. A top horizontal arm 43 of the yoke stabilizer has openings pivotally receiving the extensions 19' and 27'.

In lieu of the shafts 24 and 10 forming pivotal connections with the tops of yokes 18 and 26, such tops may be of ring form to surround the tops of rolls 17 and 25 so as to form journals therefor.

The invention embodied in the described roller adjusting mechanism is characterized by convenience, precision in operation and economy in accordance with the objectives of the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a glue pot assembly for a container labeling machine of the type wherein upright containers having recessed and non-recessed labeling areas of substantially different diameters are moved in succession past a gluing station, a glue pot fixedly disposed at the gluing station, glue applicator and fountain rolls on the glue pot and having spaced parallel upright axes, separate yokes rotatably supporting the glue applicator and fountain rolls for independent adjustment horizontally relative to each other and relative to the labeling areas of the containers, spaced parallel upright axis drive shafts on the glue pot also forming pivot elements for the yokes, separate and independent drive gearing for the glue applicator and fountain rolls including two driving gears on said drive shafts coaxial with the yoke pivot axes, the drive shafts having their parallel upright axes spaced from the rotational axes of the glue applicator and fountain rolls on said yokes, and independently operable adjusting screw shafts for the yokes on the glue pot across the pivot axes of the yokes and having swiveled connections with the yokes and with the glue pot, whereby the glue applicator and fountain rolls can be swung with the yokes independently on the pivot axes of the yokes while being continuously driven in rotation through usbstantial arcs of movement sufficient to maintain engagement of the glue applicator roll with either the recessed or non-recessed labeling areas of containers.

2. In a glue pot assembly for a container labeling machine as defined in claim 1, and a yoke stabilizer member fixed on the glue pot and having an arm disposed near the tops of said yokes, and pivot elements for the yokes on the tops of the yokes pivotally engaged with the arm and being coaxial with the axes of the drive shafts.

3. In a glue pot assembly for a container labeling machine as defined in claim 2, and the yokes being approximately C-shaped in side profile including top and bottom horizontal arms above and below the top and bottom ends of the glue applicator and fountain rolls, the bottom arms of the yokes being pivotally engaged with the drive shafts and the top arms of the yokes carrying the pivot elements.

4. In a glue pot assembly for a container labeling machine as defined in claim 1, and said separate and independent drive gearing being disposed adjacent to the lower ends of the glue applicator and fountain rolls and including a driven gear in mesh with each driving gear and being drivingly connected with the glue applicator roll and fountain roll to turn the latter.

5. In a glue pot assembly for a container labeling machine as defined in claim 1, and plural axially spaced relatively narrow glue applicator rings of equal diameters on the body portion of the glue applicator roll arranged to engage the labeling areas of the recessed and non-recessed containers.

6. In a glue pot assembly for a container labeling machine as defined in claim 3, and said separate and independent drive gearing for the glue applicator and fountain rolls being disposed near and below the ends of such rolls and between such ends and the bottom arms of said yokes.

7. In a glue pot assembly for a container labeling machine as defined in claim 1, and said adjusting screw shafts being located near the lower ends of the glue applicator and fountain rolls and the lower ends of said yokes, said swiveled connections with the yokes being with the lower ends of the yokes.

* * * * *